US006155085A

United States Patent [19]

Shindo

[11] Patent Number: 6,155,085

[45] Date of Patent: Dec. 5, 2000

[54] TAPE FOR SIZE ADJUSTING COMPONENT

[75] Inventor: Tadashi Shindo, Sakai-gun, Japan

[73] Assignees: Shindo Seni Kogyo Co., Ltd., Fukui; Morito Co., Ltd., Osaka, both of Japan

[21] Appl. No.: 09/154,085

[22] Filed: Sep. 16, 1998

[51] Int. Cl.[7] ..... D04B 23/08

[52] U.S. Cl. ..... 66/192; 66/194; 66/195

[58] Field of Search ..... 66/169 R, 170, 66/190, 191, 192, 193, 194, 195; 24/442, 306, 445, 446

[56] References Cited

U.S. PATENT DOCUMENTS 3,782,137 1/1974 Hughes ..... 66/192
3,845,641 11/1974 Waller ..... 66/192
4,709,562 12/1987 Matsuda ..... 66/193
5,472,766 12/1995 Siegel et al. ..... 66/192
5,664,441 9/1997 Clerici ..... 66/193

*Primary Examiner*—Danny Worrell
*Attorney, Agent, or Firm*—Smith, Gambell & Russell, LLP

[57] ABSTRACT

There is provided a narrow tape used as a component for adjusting the size of the waste of slacks, a skirt and the like. The tape has a ground fabric in a tape shape knitted or woven and inlay yarn integrally held by threads composing the ground fabric. The inlay yarn is thicker than the threads composing the ground fabric. A part of the inlay yarn projects from one surface of the ground fabric to form a projection. The projection includes a plurality of parts extending along the width of the ground fabric, and the parts are arranged with predetermined spacing along the length of the ground fabric to define recesses thereamong.

7 Claims, 3 Drawing Sheets

TAPE FOR SIZE ADJUSTING COMPONENT

BACKGROUND OF THE INVENTION

The present invention relates to a tape used as a component for adjusting the size of the waist of slacks, a skirt or the like or the size of a hat by sliding relative to a component in a counterpart which is paired therewith, and having a projection with which a latch of the component in the counterpart is to be engaged.

Conventionally used as the above-mentioned tape includes a stretchable tape using a high elasticity thread and a tape made of plastics.

In the stretchable tape, however, the difference in strength greatly varies depending on the degree of expansion and contraction as the tape moves, for example. The engagement of the latch becomes unstable as the tape expands and contracts at the time of the movement, so that the latch may be disengaged.

On the other hand, the tape made of plastics is scratched, for example, when it is used for sports such as golf because it is high in rigidity.

SUMMARY OF THE INVENTION

An object of the present invention is to provide a tape suitable for use as a component for adjusting the size of the waist of slacks, a skirt and the like or the size of a hat.

In order to attain the above-mentioned object, in a preferred mode of the present invention, a tape used for a component for adjusting the size to an objective size comprises a ground fabric in a tape shape and projection forming inlay yarn held by the ground fabric with partially projecting from one surface of the ground fabric to form a projection. The projection forming inlay yarn is thicker than threads composing the ground fabric. The projection includes a plurality of parts extending along the width of the ground fabric, and the parts are arranged with predetermined spacing along the length of the ground fabric, to define recesses thereamong.

According to the present mode, the recess is defined between the parts extending along the width of the ground fabric, so that the tape has projections and recesses which are suitable for an adjusting component. Moreover, the projection forming inlay yarn is thick and is integrated with the ground fabric upon being held by threads composing the ground fabric, so that the shape of the tape is stabilized.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENT

A preferred embodiment of the present invention will be described in detail while referring to the accompanying drawings.

Figure 1:
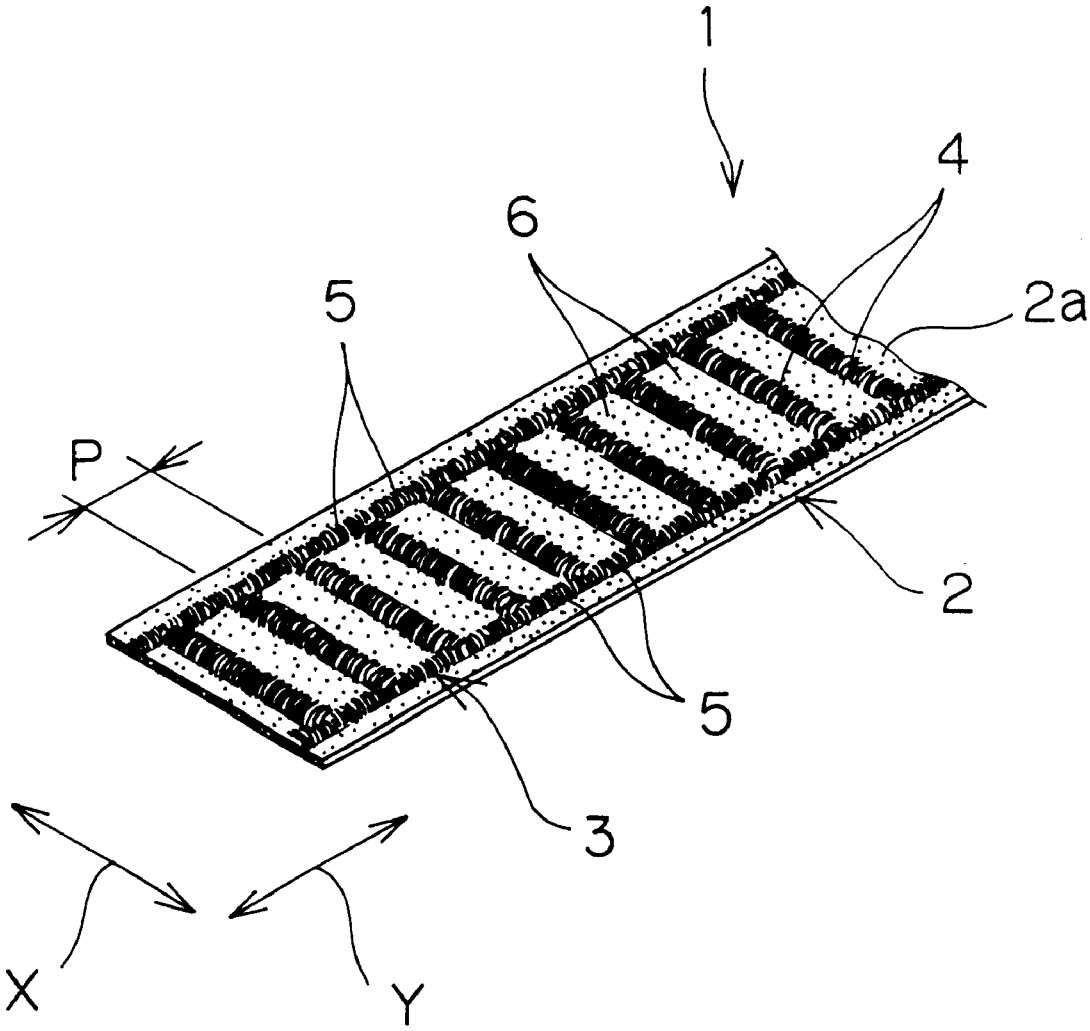
FIG. 1 is a schematic perspective view showing a tape as one embodiment of the present invention.

Referring to FIG. 1, a tape 1 according to an embodiment of the present invention is narrow and extends continuously along its length.

A tape 1 comprises a ground fabric 2 formed by knitting or weaving, and a projection 3 projecting from one surface 2*a* of the ground fabric 2. The projection 3 comprises a plurality of first parts 4 extending along the width X of the ground fabric 2 and a plurality of second parts 5 extending along the length Y of the ground fabric 2.

The first parts 4 of the projection 3 are arranged with predetermined spacing P along the length Y of the ground fabric 2. A recess 6 is defined between the adjacent first parts 4.

Figure 2:
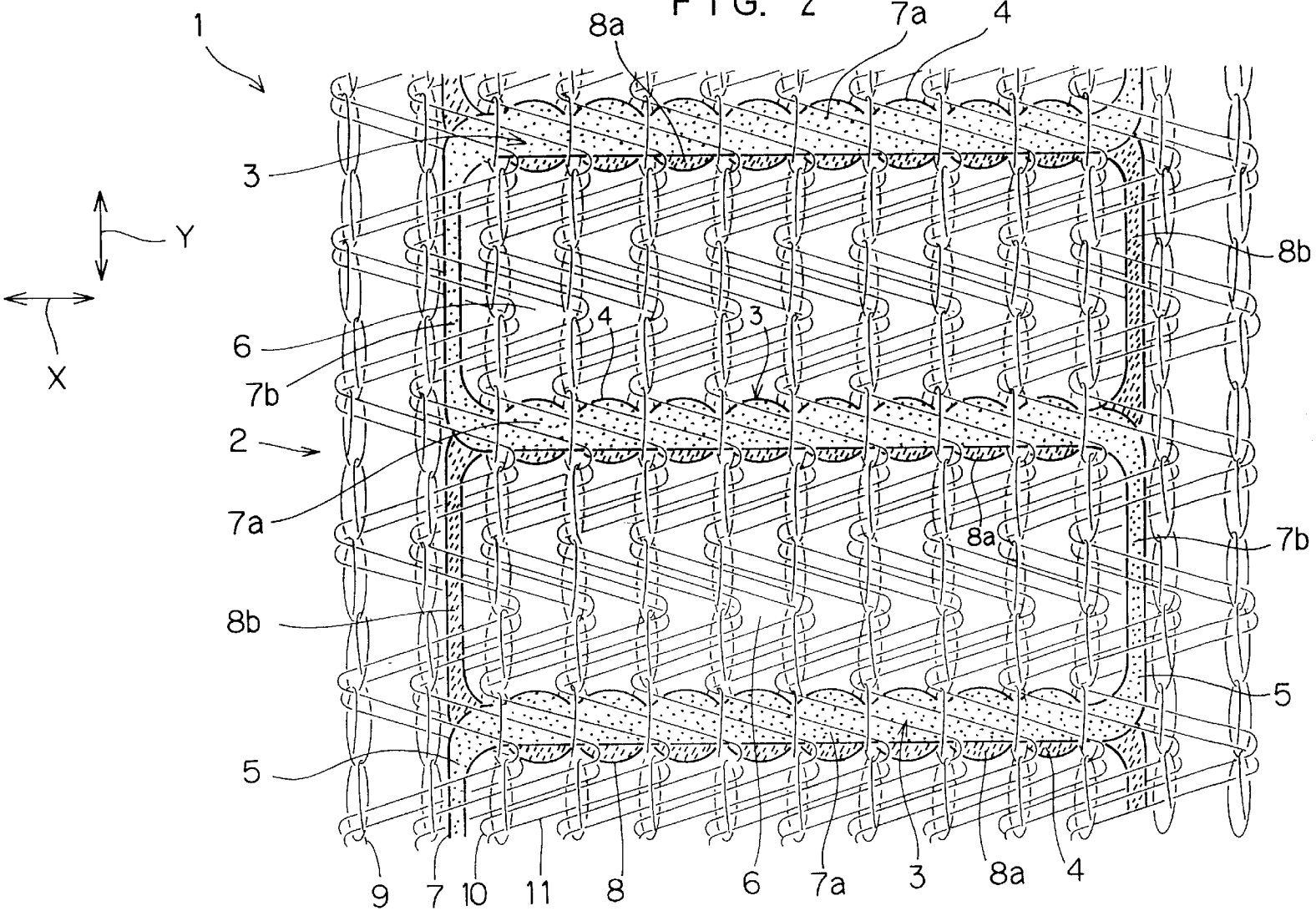
FIG. 2 is a schematic plan view showing a knitting tissue of the tape.

The projection 3 is formed by projecting respective parts of two projection forming inlay threads 7 and 8 as shown in FIG. 2 from the one surface 2*a* of the ground fabric 2. Each of the inlay threads 7 and 8 is thicker than threads composing the ground fabric 2.

Referring to FIG. 2, the first and second inlay threads 7 and 8 for forming the projection 3 respectively include a plurality of first parts 7*a* and 8*a* extending along the width X of the ground fabric 2 and a plurality of second parts 7*b* and 8*b* extending along the length Y of the ground fabric 2. The first and second parts 7*a* and 7*b* of the first inlay thread 7 are alternately connected in a zigzag. The first inlay thread 7 forms a succession of approximately S shapes as a whole, and the second inlay thread 8 also similarly forms a succession of approximately S shapes.

The first and second inlay threads 7 and 8 are shifted from each other along the length Y of the ground fabric 2 by a distance corresponding to the above-mentioned spacing P. Consequently, the first parts 7*a* and 8*a* of the first and second inlay threads 7 and 8 are overlapped with each other. The second parts 7*b* and 8*b* of the first and second projection forming inlay threads 7 and 8 are prevented from being overlapped with each other.

FIG. 2 schematically illustrates a case where the ground fabric 2 is knitted by a warp knitting machine. The ground fabric 2 comprises a plurality of chain stitch threads 9 forming wales which extends along the length Y of the ground fabric 2 and first and second racked inlay threads 10 and 11 each being wound in a zigzag several wales along the width X of the ground fabric 2 and entangled in the plurality of chain stitch threads 9 which cross one another.

Each of the first and second projection forming inlay threads 7 and 8 is inserted between the first racked inlay thread 10 and the second racked inlay thread 11 and is interposed between the first and second racked inlay threads 10 and 11.

The respective first parts 7*a* and 8*a* of the first and second projection forming inlay threads 7 and 8 are inserted through a chain loop of each of the crossing chain stitch threads 9 in the wale and held by the chain stitch thread 9.

The following are examples of the material of threads used. That is, polypropylene (340 deniers, Pyrene (Trade Name)) can be used as each of the chain stitch threads 9, the racked inlay threads 10 and 11, and the projection forming inlay threads 7 and 8.

Further, polyamide thread (for example, black raw material thread of 210 deniers) can be used as a material for the chain stitch threads and racked inlay threads 10 and 11, and polyamide (for example, black raw material thread of 630 deniers) can be used as a material for the projection forming inlay threads 7 and 8.

Single yarn is used as the chain stitch threads 9 and the racked inlay threads 10 and 11, and 15-paralleled yarn can be used as the projection forming inlay threads 7 and 8 each composed of a thick thread.

The zigzag widths, along the width X of the ground fabric 2, of the projection forming inlay threads 7 and 8 can be varied in carrying out knitting, so that the inlay patterns of the racked inlay threads 10 and 11 and the number of racked inlay threads can be varied.

According to the present embodiment, in knitting the ground fabric 2, for example, the inlay threads 7 and 8 being thicker than threads composing the ground fabric 2 are racked along the width X to form the projections 3 projecting from the one surface 1*a* of the ground fabric 2 apart from each other, so that the recess 6 can be formed between the adjacent projections 3.

Moreover, since the inlay threads 7 and 8 composed of thick threads which forming the projections 3 are held in the threads 9, 10 and 11 composing the ground fabric 2 and are integrated with the ground fabric 2, the whole of the tape 1 including the projections 3 can be maintained in a stable shape against the load. Consequently, it is possible to provide a tape which is easily used as a component for slide-adjusting the size of the waste of slacks, a skirt and the like or the size of a hat. The quantity production of the tape is possible, so that the production costs thereof can be significantly reduced.

Particularly, the recesses 6 which are completely independent with each other are formed between the projections 3 using the two inlay threads 7 and 8 wound in a zigzag, so that it is possible to provide a significantly stable tape wherein the projections 3 and the recesses 6 are constructed by changing a fabric tissue itself, more suitable for an adjusting component. Therefore, it is possible to exhibit an unique use effect which is not given in the conventional adjusting component used as the stretchable tape or the plastic tape.

Figure 3:
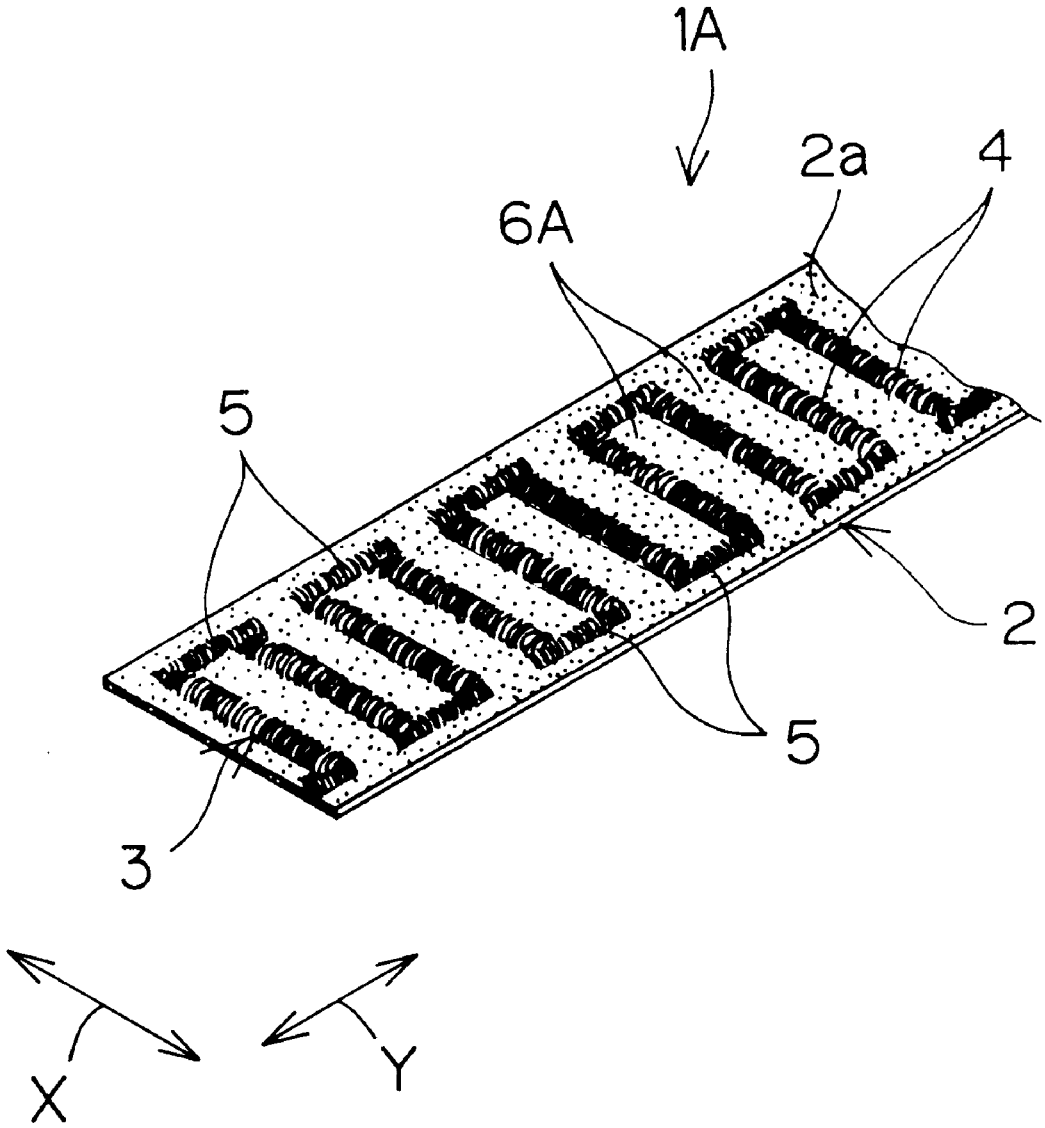
FIG. 3 is a schematic perspective view of a tape in another embodiment of the present invention.

Although in the above-mentioned embodiment, description was made of a case where the projection forming inlay threads 7 and 8 are paired, the present invention is not limited to the same. For example, if the tape is sufficiently held by the chain stitch threads 9 and the racked inlay threads 10 and 11 in the ground fabric 2, the projections 3 may be formed by single projection forming inlay yarn as shown in FIG. 3. In this case, a recess 6A between the projections 3 is partially opened unlike the completely independent recess 6 of FIG. 1. If a first part 4 of the projection 3 can be engaged with a latch of a counterpart, the projection 3 can be sufficiently made use of.

Although in each of the above-mentioned embodiments, the tape is a narrow tape using a knitted fabric of warp knitting as a ground fabric, it can be formed by racking and weaving the thicker threads in practice.

In addition thereto, it is possible to make various design changes in the scope of the present invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A tape for a component for adjusting a counterpart size, comprising:

a ground fabric in a tape shape; and projection forming inlay yarn held by the ground fabric and partially projecting from a surface of the ground fabric to form a projection, wherein the projection forming inlay yarn is thicker than threads composing the ground fabric, the projection includes a plurality of parts extending along the width of the ground fabric, the parts of the projection extending along the width of the ground fabric are arranged with predetermined spacing along a length of the ground fabric to define recesses thereamong.

2. The tape according to claim 1, wherein the projection forming inlay yarn includes a set of plurality of threads.

3. The tape according to claim 1, wherein the projection forming inlay yarn comprises a plurality of first parts extending along the width of the ground fabric and a plurality of second parts extending along the length of the ground fabric, the first and second parts of the projection forming inlay yarn being alternately connected in a zigzag.

4. The tape according to claim 3, wherein the projection forming inlay yarn includes first and second projection forming inlay threads, the first and second projection forming inlay threads are shifted from each other along the length of the ground fabric by a distance corresponding to the predetermined spacing, the respective first parts of the first and second projection forming inlay threads are overlapped with each other, and the respective second parts of the first and second projection forming inlay threads are inhibited from being overlapped with each other.

5. The tape according to claim 1, wherein the ground fabric comprises a plurality of chain stitch threads forming wales extending along the length of the ground fabric and first and second racked inlay threads each got entangled in the plurality of chain stitch threads crossing one another upon being wound in a zigzag along the width of the ground fabric.

6. The tape according to claim 5, wherein the projection forming inlay thread is interposed between the first and second racked inlay threads.

7. The tape according to claim 5, wherein the first parts of the projection forming inlay yarn are inserted into a chain loop of each of the chain stitch threads in each of the wales.

* * * * *